US007176954B2

(12) United States Patent
Takahashi et al.

(10) Patent No.: US 7,176,954 B2
(45) Date of Patent: Feb. 13, 2007

(54) THERMAL ACTIVATION DEVICE

(75) Inventors: Masanori Takahashi, Chiba (JP); Minoru Hoshino, Chiba (JP); Yoshinori Sato, Chiba (JP); Tatsuya Obuchi, Chiba (JP)

(73) Assignee: Seiko Instruments Inc. (JP)

( * ) Notice: Subject to any disclaimer, the term of this patent is extended or adjusted under 35 U.S.C. 154(b) by 184 days.

(21) Appl. No.: 10/958,070

(22) Filed: Oct. 4, 2004

(65) Prior Publication Data

US 2005/0088507 A1 Apr. 28, 2005

(30) Foreign Application Priority Data

Oct. 16, 2003 (JP) ..... 2003-356351

(51) Int. Cl.
*B41J 2/00* (2006.01)

(52) U.S. Cl. ..... 347/191

(58) Field of Classification Search ..... 347/171, 347/191, 223, 187–189, 194–197; 400/120.09, 400/120.11, 279

See application file for complete search history.

(56) References Cited

U.S. PATENT DOCUMENTS 3,453,647 A * 7/1969 Zucker et al. ..... 347/171
5,524,993 A * 6/1996 Durst ..... 400/279
5,650,037 A 7/1997 Larson ..... 156/540
6,337,704 B1 * 1/2002 Yamaguchi ..... 347/191
6,819,347 B2 * 11/2004 Saquib et al. ..... 347/194

FOREIGN PATENT DOCUMENTS

WO 0023330 4/2000
WO 0212071 2/2002

* cited by examiner

*Primary Examiner*—K. Feggins
(74) *Attorney, Agent, or Firm*—Adams & Wilks

(57) ABSTRACT

A thermal activation device has a thermal head having heat generating elements for generating heat to heat a thermal activation sheet. A radiator absorbs and dissipates heat generated by the heat generating elements of the thermal head. The radiator has a portion disposed in contact with an introduction path along which the thermal activation sheet is introduced toward the thermal head for contacting the thermal activation sheet to preheat the thermal activation sheet as the thermal activation sheet advances in the introduction path.

22 Claims, 5 Drawing Sheets

THERMAL ACTIVATION DEVICE

BACKGROUND OF THE INVENTION

1. Field of the Invention

The present invention relates to a thermal activation device for heating an adhesive layer of a thermal activation sheet by a thermal head to thereby cause the thermal activation sheet to develop adhesiveness.

2. Description of the Related Art

Thermal activation labels are increasingly used as labels affixed to products manufactured and sold in processed food factories, supermarkets, etc. for indicating such information as product name, price, sellby date, etc. A thermal activation label includes an adhesive layer, which does not normally exhibit adhesiveness, the adhesive layer being activated when applied with a thermal energy, making it possible to affix the adhesive layer to a target object. Sheets having a similar adhesive layer, including the above thermal activation label, are herein referred to under the generic term "thermal activation sheet".

As a conventional thermal activation device for activating such a thermal activation label, a device as disclosed in JP 11-79152 A has been put into practical use. This device includes a thermal head composed of a large number of heat generating elements arranged in one or multiple rows on a substrate. A thermal activation label is passed between the thermal head and a platen roller pressed against the thermal head to heat the thermal activation label, thereby activating an adhesive layer thereof. The use of such a thermal head provides such advantages as allowing a reduction in the overall size of the device as well as enabling a partial activation, whereby only an intended portion of the label can be activated.

In order to effect a clear separation between a thermal-activation portion and a non-thermal-activation portion when performing partial activation or the like in the thermal activation device, the heat generating elements must be able to effect heating and heat dissipation instantaneously. Further, in the case where the entire label surface is to be activated, to reliably activate the label up to its edge portion, it is necessary for the heat generating elements to be able to heat the thermal activation label to a fixed temperature or more instantaneously as the leading edge thereof approaches and reaches the position of the heat generating elements, and to effect heat dissipation instantaneously to lower the temperature of the thermal activation label to below the fixed temperature as the trailing edge thereof passes the position of the heat generating elements and the platen roller and thermal head come into direct contact with each other.

For this reason, conventional thermal activation devices employing a thermal head uses heat generating elements capable of outputting a large heat quantity to realize instantaneous heating. In addition, to realize instantaneous heat dissipation, a large radiator plate made of a material exhibiting high heat conductivity, such as aluminum, must be provided on the back surface of the thermal head. Therefore, the requisite power consumption and volume of the conventional thermal activation devices are large.

SUMMARY OF THE INVENTION

It is an object of the present invention to provide a thermal activation device which enables reduced power consumption and reduced device volume while effecting a clear separation between an activation portion and a non-activation portion of a thermal activation label.

To attain the above object, according to the present invention, there is provided a thermal activation device for heating a thermal activation sheet by using a thermal head having heat generating elements formed therein, the thermal activation device including a radiator adapted to absorb and dissipate a heat of the thermal head and having a portion of the radiator arranged in contact with an introduction path along which the thermal activation sheet is introduced toward the thermal head, the portion of the radiator being brought into contact with the thermal activation sheet to effect preheating as the thermal activation sheet advances in the introduction path.

With the above arrangement, the thermal activation sheet is preheated before it is transported into the location of the heat generating elements of the thermal head, whereby the thermal activation sheet can be activated with a small heat quantity as compared with the case where no preheating is performed. Further, heat is transferred from the radiator to the thermal activation sheet, whereby the same amount of heat dissipation can be attained with less volume as compared with the case where heat is dissipated through radiation or heat is simply dissipated to the atmosphere. Therefore, it is possible to achieve a reduction in power consumption and a decrease in the overall volume of the device.

It is desirable to provide temperature detecting means for detecting the temperature of the radiator.

The temperature of the radiator is not constant but varies depending on how the heat generating members are driven or how the activation sheet flows, and hence detecting the temperature thereof enables various measures to be implemented.

Specifically, the thermal activation device may be provided with control means for controlling an amount of heat applied from the thermal head to the thermal activation sheet, the control means changing the amount of heat applied to the thermal activation sheet based on a detection result from the temperature detecting means.

By adopting such means, the activation sheet can be activated at an appropriate temperature at all times, and wasteful heat generation by the thermal head can be suppressed, making it possible to achieve a further reduction in power consumption.

Here, the control means for controlling the heat quantity can be implemented by controlling the amount of energization of the heat generating elements, by controlling the number of heat generating elements to be energized, or, alternatively, by providing drive means for performing drive to transport the thermal activation sheet at a controlled variable speed, the control means controlling the drive means to vary a transport speed for the thermal activation sheet.

Further, it is desirable that a portion of the radiator which comes into contact with the thermal activation sheet be provided with a member having a lower heat conductivity than that of the other portion of the radiator. With this arrangement, even when the temperature of the radiator changes abruptly, only moderate temperature changes take place in the portion coming into contact with the thermal activation sheet, making it possible to reduce unevenness in the preheating of the thermal activation sheet.

According to the thermal activation device of the present invention, the heat transferred from the heat generating elements to the radiator is reused for preheating the thermal activation sheet, whereby activation of the thermal activation sheet can be effected with a small heat generation amount and, because the heat is allowed to escape from the radiator to the thermal activation sheet, the efficiency with which the radiator dissipates heat can be enhanced as well.

Therefore, it is possible to achieve both a reduction in power consumption and miniaturization of the radiator.

Furthermore, in addition to dissipating heat to the ambient air or through radiation, the radiator dissipates heat to the thermal activation sheet, whereby it is possible to suppress a temperature rise inside the casing of the device.

DETAILED DESCRIPTION OF THE PREFERRED EMBODIMENTS

Hereinbelow, embodiments of the present invention are described with reference to the drawings.

Figure 1:
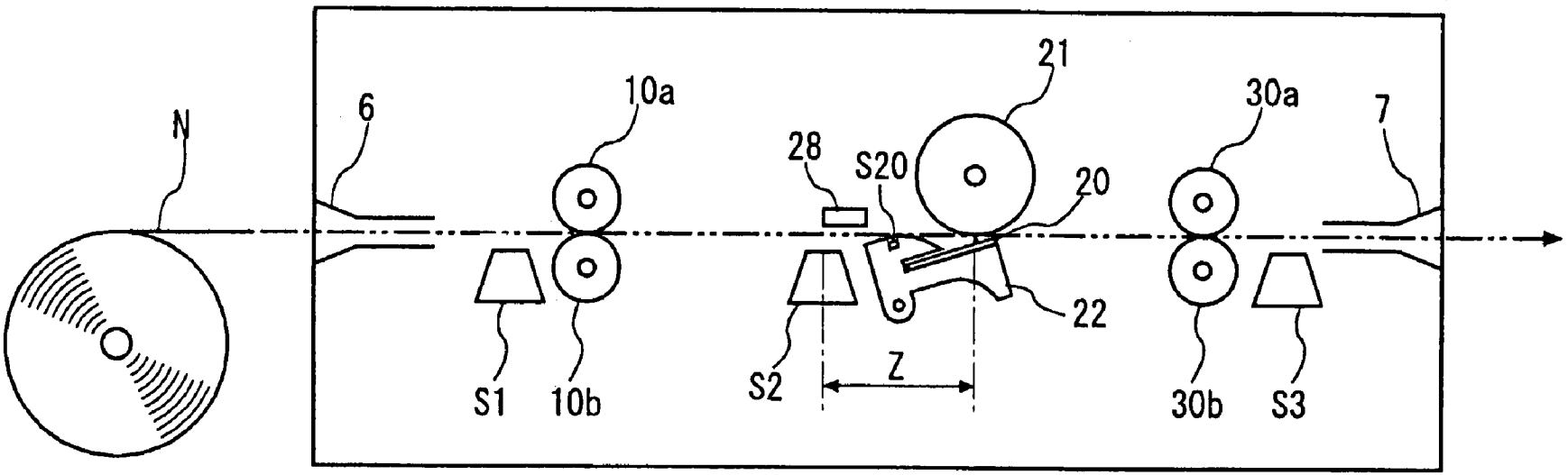
FIG. 1 is a diagram showing the overall construction of a thermal activation device according to an embodiment of the present invention.

FIG. 1 shows the general construction of a thermal activation device according to an embodiment of the present invention.

The thermal activation device according to this embodiment comprises paper insertion rollers 10*a* and 10*b* for introducing a thermal activation sheet N, which is cut into a predetermined length, through an introduction port 6 feeding it to the interior portion of the device; a paper insertion detecting sensor S1 which detects the presence/absence of the thermal activation sheet N that has been inserted from the introduction port 6; a thermal head 20 having a large number of heat generating elements formed on a substrate in one or multiple rows; a platen roller 21 for effecting paper feeding while pressing the thermal activation sheet N against the portion of the thermal head 20 where the heat generating elements are formed; a radiator plate 22 supporting the thermal head 20 while cooling the thermal head 20; a sensor S2 for detecting paper in the thermal head portion (hereinafter referred to as the "thermal head portion paper detecting sensor) which detects the presence/absence of the thermal activation sheet N that has been transported into the location of the thermal head 20; paper discharge rollers 30*a* and 30*b* for sending the thermal activation sheet N toward a discharge port 7; and a paper discharge detecting sensor 31 which detects the presence/absence of the thermal activation sheet N at a position forward of the discharge port 7.

Further, arranged upstream from the above thermal activation device are a roller paper accommodating portion for accommodating roll paper consisting of a thermal activation sheet wound into a roll, a printing device (not shown) which performs printing on a print surface on the backside of an adhesive layer surface of the thermal activation sheet, and a cutting device (not shown) for cutting the thermal activation sheet as it is continuously fed into a predetermined length and supplies the cut sheet to the thermal activation device. The thermal activation sheet N, which has been thus cut into the predetermined length and supplied by those components, is sent from the introduction port 6 to the paper insertion rollers ba and lob, the thermal head 20, and then to the paper discharge rollers 30*a* and 30*b* sequentially before being discharged from the discharge port 7.

It is to be noted that while the transport path for the thermal activation sheet N is substantially linear in FIG. 1, the transport path may be formed as a curved path by providing, at some midpoint in the path, a guide or the like for guiding the thermal activation sheet N.

Figure 2:
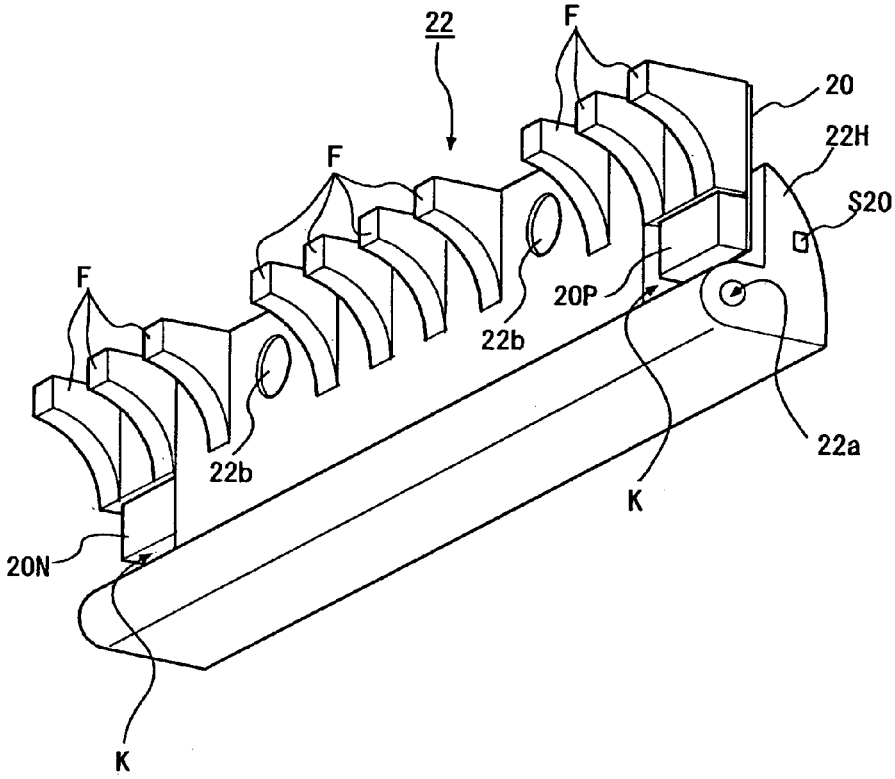
FIG. 2 is a perspective view showing a thermal head and a radiator plate which are shown in FIG. 1.
Figure 3:
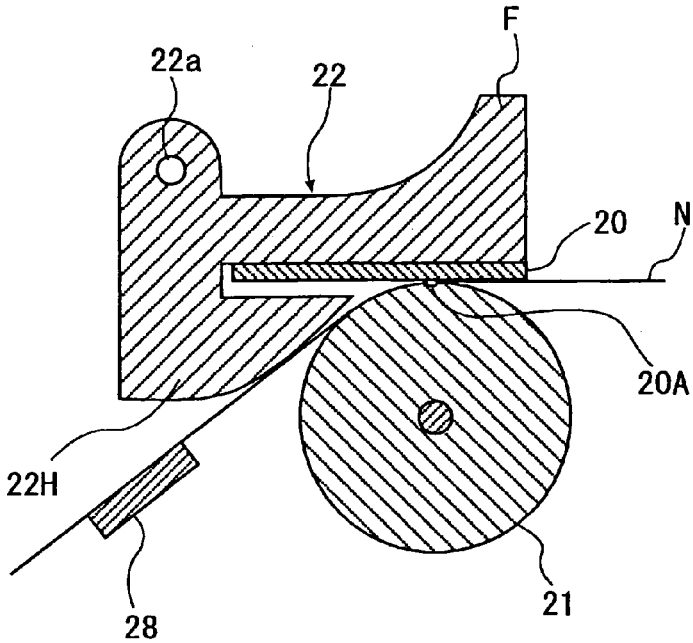
FIG. 3 is a longitudinal sectional view showing the thermal head and the radiator plate.

FIG. 2 is a perspective view showing the thermal head 20 and the radiator plate 22 in detail, and FIG. 3 is a longitudinal sectional view thereof.

The radiator plate 22 is made of a member having a high heat conductivity, such as aluminum, which is bonded onto the back surface of the thermal head 20 to let the heat of the thermal head 20 escape into the ambient air or dissipate through radiation. Formed on the back surface side of the radiator plate 22 are fins F provided for enhancing the heat dissipation efficiency. Further, notches K are formed at positions of the radiator plate 22 corresponding to the right and left sections on the back surface of the thermal head 20. Connection terminals 20P and 20N for energizing the thermal head 20 are exposed at the location of those notches.

The radiator plate 22 also functions as a frame for axially supporting the thermal head 20 such that the thermal head 20 can freely rotate. The radiator plate 22 is axially supported to the frame of the device through a shaft hole 22*a*. Further, the thermal head 20 is pressed against the platen roller 21 as one end of a spring is brought into abutment against recessed portions 22*b* formed on the back surface side. The platen roller 21 is so placed as to be pressed against a heat generating element forming portion 20A of the thermal head 20 (FIG. 3).

Further, formed in the radiator plate 22 is an overhanging portion 22H overhanging to the front side of the thermal head 20, with the overhanging portion 22H coming into contact with the thermal activation sheet N in the sheet transport path between a guide 28 and the platen roller 21. The portion of the overhanging portion 22H which comes into contact with the sheet is formed as a curved surface with a modest curvature, contacting the thermal activation sheet N over a fixed area. A temperature sensor S20 such as a thermistor is mounted on either side surface of the overhanging portion 22H.

Figure 4:
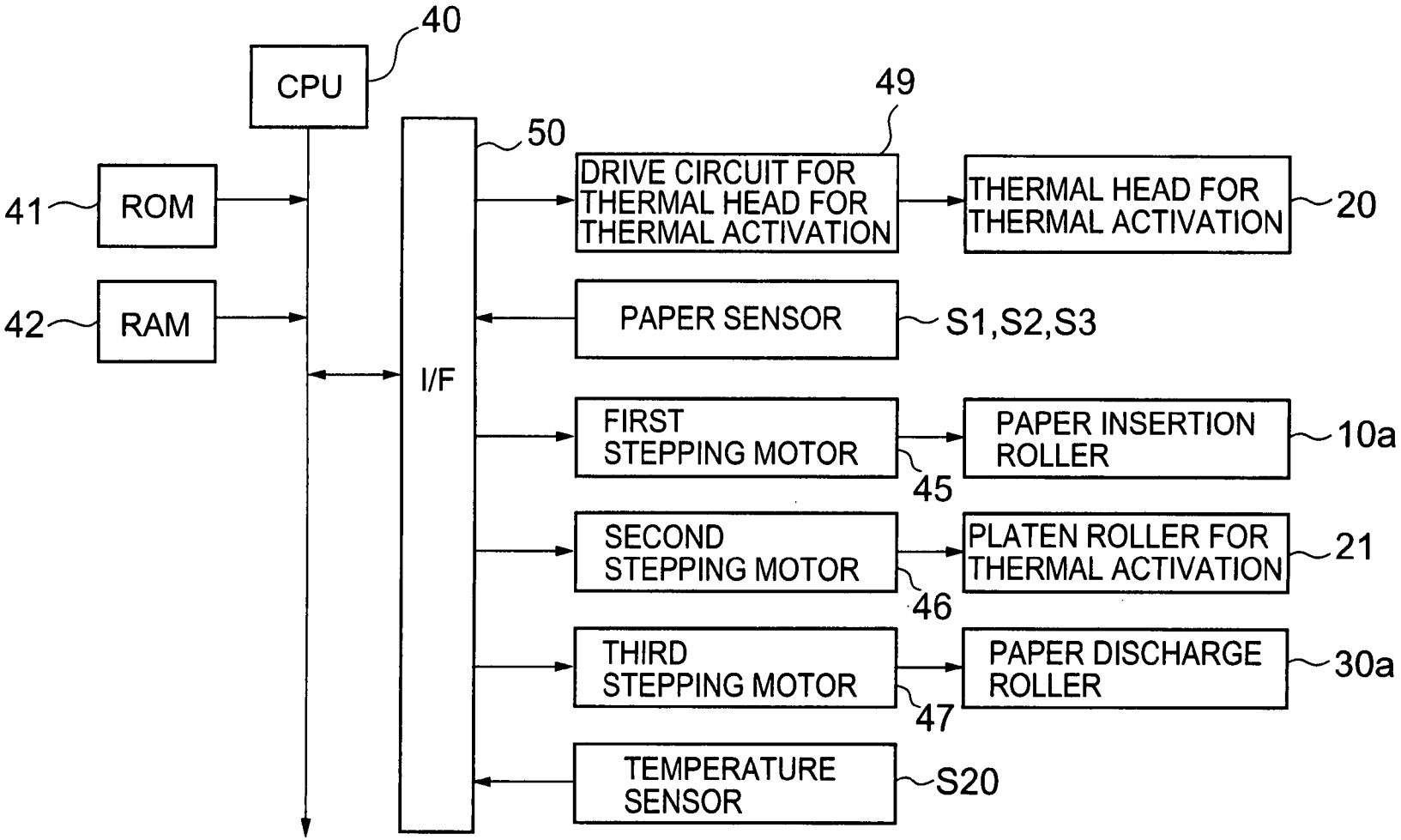
FIG. 4 is a block diagram showing the configuration of a control system of the thermal activation device according to the embodiment of the present invention.

FIG. 4 is a block diagram showing a control system of the thermal activation device of this embodiment.

In the thermal activation device of this embodiment, the control system comprises a Cpu (Central Processing Unit) 40 which controls the device as a whole; a ROM (Read Only Memory) 41 storing a control program and control data executed by the CPU 40; a RAM (Random Access Memory) 42 which provides a working area for the CPU 40; first to third drive motors 45 to 47 such as stepping motors for driving the paper insertion roller 10*a*, the platen roller 21, and the paper discharge roller 30*a* such that their respective drive amounts can be controlled; a thermal head driving circuit 49 for supplying a drive current to the heat generating elements of the thermal head 30; and an interface 50 for making input/output of signals between the CPU 40 and respective drive portions or sensors.

The interface 50 is connected with the detecting sensors S1 to S3 for detecting the presence/absence of the thermal activation sheet N, the temperature sensor S20 for the radiator plate 22, which are described above, and the like.

Hereinbelow, description is made on operations for controlling the thermal activation device configured as described above.

Figure 5:
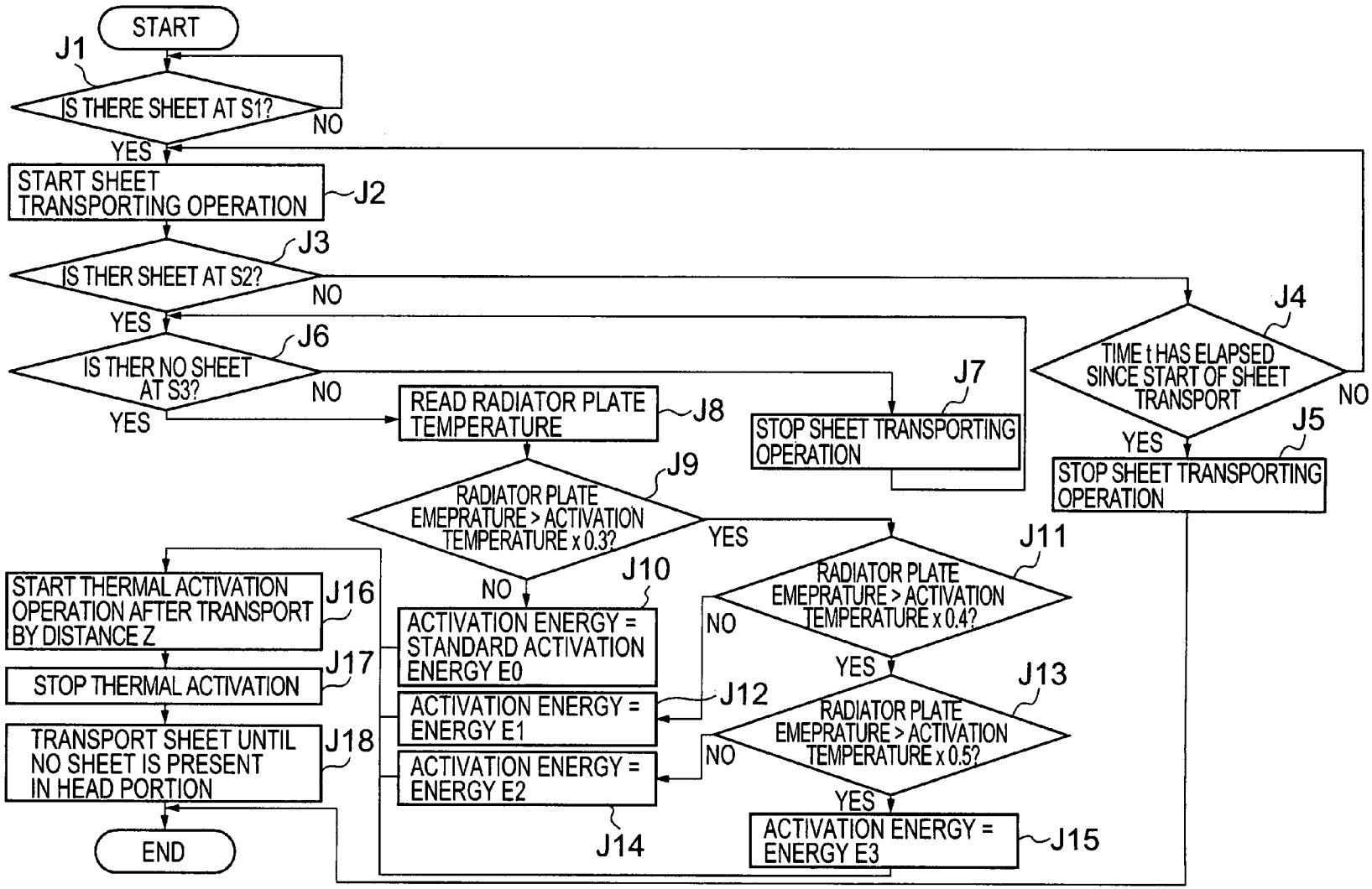
FIG. 5 shows a first example of a flow chart illustrating a flow of control processing executed by a CPU shown in FIG. 4.

FIG. 5 shows a first example of a flowchart explaining the control program for the thermal activation device executed by the CPU 40.

The control program effects a control such that the thermal activation sheet N is transported at appropriate timings within the device, and that when thermally activating the thermal activation sheet N with the thermal head, the thermal activation energy of the thermal head 20 is varied according to the temperature of the radiator plate 22.

Once the processing of the flowchart commences upon input of an operation ON signal to the thermal activation device, first, in step J1, it is determined whether or not the thermal activation sheet N has been supplied to the location of the paper insertion rollers 10*a* and 10*b* by checking a signal from the detecting sensor S1 present in the paper introduction portion. If the result of the determination indicates that the thermal activation sheet N has not been supplied, the processing of step J1 is repeated; once a positive determination has been made, the process then transfers to step J2.

In step J2, the drive motors 45 to 47 are driven to start the transporting of the thermal activation sheet N, and then the process transfers to step J3.

In step J3, the signal of the detecting sensor S2 in the intermediate section of the device is checked to determine whether or not the thermal activation sheet N to be transported to the location of the thermal head 20 has been detected. If the determination is positive, the process transfers to J6. Meanwhile, if the determination is negative, the process transfers to step J4 to determine whether or not a predetermined period of time t (for example, 0.5 to 1 second) has elapsed since the start of the sheet transport. If the determination is negative, the process returns to step J2 again to continue the transporting of the sheet; if it is determined that the predetermined period of time t has elapsed, an error is judged to have occurred, so that the transporting of the sheet is stopped and the processing of the flowchart ends.

When the detecting sensor S2 in the intermediate section detects the thermal activation sheet N, the process transfers to step J6 where the signal of the detecting sensor S3, located in the paper discharge position, is checked to determine whether or not the thermal activation sheet N, which has been discharged to the position of the discharge port 7 in the previous processing, has been drawn out. If the determination is positive, the process transfers to thermal activation processing of step J8 onward, but if the thermal activation sheet N remains at the discharge port 7 without being drawn out therefrom, the drive motors 45 to 47 are stopped in step J7 and the process returns to step J6 again.

Once the thermal activation processing becomes ready with no previously processed thermal activation sheet remaining at the discharge port 7, the process transfers to step J8 where the detection signal of the temperature sensor S20 is read, and then the process transfers to step J9. Thereafter, through the processing of steps J9 to J15, the thermal activation energy is set as shown in items A to D below in accordance with the thus read temperature.

A: The temperature of the radiator plate 22 is lower than 0.3 times the activation temperature for the thermal activation sheet N→A standard activation energy E0 is set as the thermal activation energy.

B: The temperature of the radiator plate 22 is within the range of 0.3 to 0.4 times the activation temperature→An energy E1 is set as the thermal activation temperature.

C: The temperature of the radiator plate 22 is within the range of 0.4 to 0.5 times the activation temperature→An energy E2 is set as the thermal activation temperature.

D: The temperature of the radiator plate 22 is equal to or higher than 0.5 times the activation temperature→An energy E3 is set as the thermal activation temperature.

Herein, the standard activation energy E0 refers to a magnitude of energy suitable for activating the thermal activation sheet N with the radiator plate 22 being at room temperature. Further, the energies E1 to E3 are values within the range of, for example, 0.5 to 0.95 times the standard activation energy E0, and satisfy a relationship of energy E1>energy E2>energy E3.

That is, when the temperature of the radiator plate 22 is high and, as a result, the temperature of the thermal activation sheet N becomes high, the thermal activation energy of the thermal head 20 is set low, whereas when, conversely, the temperature of the radiator plate 22 is low and the preheating temperature of the thermal activation sheet N thus becomes low, the thermal activation energy of the thermal head 20 is set high. The respective values of the energies E1 to E3 vary according to such factors as the contact surface area, the contact strength, and also the kind of the thermal activation sheet N, and are dictated by how much the thermal activation sheet N is elevated in temperature through preheating with the radiator plate 22.

Further, the actual setting of the thermal activation energy is made by setting the amount of energization of the heat generating elements or the number of heat generating elements to be energized.

Once the setting of the thermal activation energy is completed through the processing of steps J9 to J15, in the subsequent step J16, the thermal activation sheet N is advanced by a distance Z, and just as the leading edge thereof is about to reach the location of the heat generating element forming portion 20A of the thermal head 20, the thermal head 20 is driven, thereby starting the thermal activation operation. During the thermal activation operation, the drive of the heat generating elements is performed by the energization method set in steps J9 to J15 mentioned above.

Subsequently, the following processing steps are carried out in sequential order, namely, stopping the thermal activation operation (energization of the heat generating elements) upon completing the thermal activation operation of a predetermined length of time (step J17), and stopping the transporting operation once the thermal activation sheet N has been transported to a position where the trailing edge of the thermal activation sheet N passes through between the thermal head 20 and the platen roller 21 (step J18), thus completing thermal activation processing for one sheet.

With the control program configured as described above, the thermal activation energy of the thermal head 20 is adjusted for each of the case where the frequency of the thermal activation processing is low and the temperature of the radiator plate 22 is low and the case where the frequency of the thermal activation processing is high and the temperature of the radiator plate 22 is high, thus effecting the activation of the thermal activation sheet N with the minimum required energy.

Figure 6:
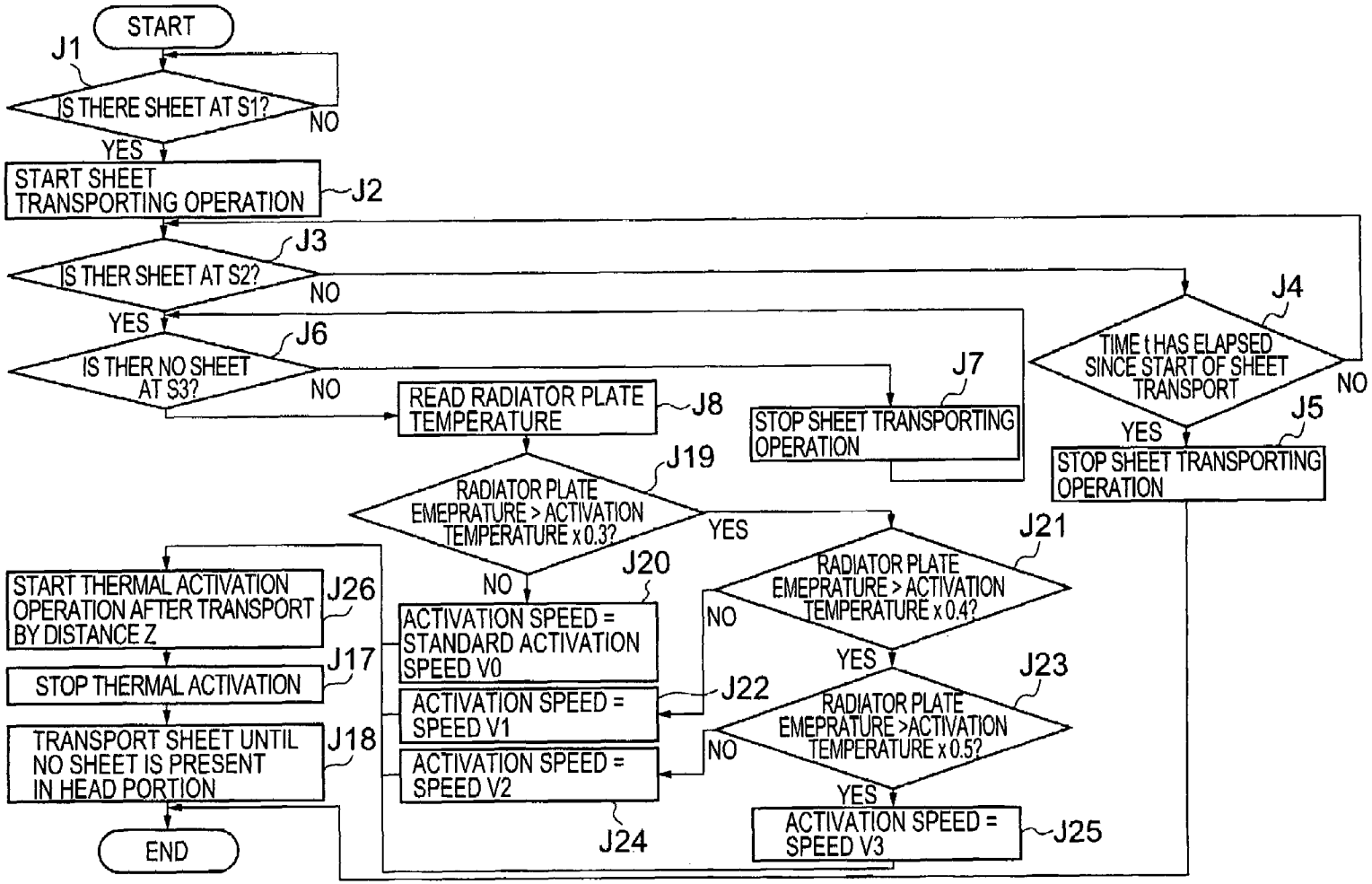
FIG. 6 shows a second example of the flow chart illustrating a flow of control processing executed by a CPU shown in FIG. 4.

FIG. 6 shows a second example of a flowchart explaining the control program of the thermal activation device executed by the CPU 40.

The control program according to the second example is different from the control program shown in FIG. 5 only in the operations and settings for the thermal activation processing; otherwise, this control program executes the same processing as that of FIG. 5. Therefore, description of the same or identical processing is omitted, and the following description focuses only on the setting processing of steps J19 to J25 and the thermal activation processing of step J26.

Referring to the flowchart, the temperature of the radiator plate 22 is read in step J8 and the process transfers to step J19 where, through the processing of steps J19 to J25, the transport speed (hereinafter referred to as the "activation speed") for the thermal activation sheet N is set as shown in items A to D below in accordance with the thus read temperature.

A: The temperature of the radiator plate 22 is lower than 0.3 times the activation temperature for the thermal activation sheet N→A standard activation speed V0 is set as the activation speed.

B: The temperature of the radiator plate 22 is within the range of 0.3 to 0.4 times the activation temperature→A speed V1 is set as the activation speed.

C: The temperature of the radiator plate 22 is within the range of 0.4 to 0.5 times the activation temperature→A speed V2 is set as the activation speed.

D: The temperature of the radiator plate 22 is equal to or higher than 0.5 times the activation temperature→A speed V3 is as the activation speed.

Herein, the standard activation speed V0 refers to a transport speed suitable for activating the thermal activation sheet N with the radiator plate 22 being at room temperature. Further, the speeds V1 to V3 are values within the range of, for example, 1. 05 to 1.8 times the standard activation speed V0, and satisfy a relationship of speed V1>speed V2>speed V3. The respective values of the speeds V1 to V3 vary according to such factors as the surface area or speed of contact between the radiator plate 22 and the thermal activation sheet N, and also the kind of the thermal activation sheet N, and are dictated by how much the thermal activation sheet N is elevated in temperature through preheating with the radiator plate 22.

Then, once the setting of the thermal activation energy is completed through the processing of steps J19 to J25, then, in step J26, the thermal activation sheet N is advanced by a distance Z, and just as the leading edge thereof is about to reach the location of the heat generating elements of the thermal head 20, the platen roller 21 is rotated such that the thermal activation sheet N advances at the set activation speed and, at the same time, the thermal head 20 is driven, thus executing the thermal activation processing.

By varying the transport speed for the thermal activation sheet N in this way, it is possible, while keeping the amount of heat generation by the thermal head 20 constant, to vary the quantity of heat applied per unit area from the thermal head 20 to the thermal activation sheet N.

As described above, according to the thermal activation device of this embodiment, the preheating of the thermal activation sheet N is effected by reusing the heat of the radiator plate 22, with a result that the thermal activation sheet N can be activated with a small heat quantity as compared with the case where no preheating is performed, making it possible to reduce power consumption.

Further, the heat is transferred from the radiator plate 22 to the thermal activation sheet N, whereby the equivalent heat dissipation effect can be attained with a small volume as compared with the case where heat is dissipated through radiation or heat is simply dissipated to the air. Therefore, it is possible to achieve miniaturization of the device. Further, a temperature rise inside the casing of the device can be suppressed.

Further, the temperature of the radiator is detected and the quantity of heat applied from the thermal head 20 to the thermal activation sheet N per unit area is adjusted based on the thus detected temperature, whereby the thermal activation sheet N can be activated with the minimum required power consumption, and at an appropriate temperature at all times.

It is to be noted that the thermal activation device of the present invention is not limited to the above embodiment and can be subject to various modifications. For example, while in the above embodiment the radiator plate 22 also serves as a support frame for supporting the thermal head 20, it is also possible to form a support frame and the radiator plate 22 as separate components.

Further, while in the above embodiment the radiator plate 22, including the portion thereof that comes into contact with the thermal activation sheet N, is formed of one metal, the portion that comes into contact with the thermal activation sheet N may be formed by using a material having a lower heat conductivity (e.g. alloy having a low heat conductivity) than that of the other portion thereof. As a result, even in the case where, for instance, the temperature of the radiator plate 22 changes abruptly as the thermal head 20 is turned on and off, temperature changes can be suppressed in the portion of the radiator plate 22 which comes into contact with the thermal activation sheet N, whereby unevenness in preheating does not develop in the thermal activation sheet. Further, use of a member having a low heat conductivity, such as one formed of polyimide, can prevent overheating of the thermal activation sheet N during preheating, and interposing a member that facilitates sliding, such as one formed of fluorine resin, can prevent jam of the thermal activation sheet N during preheating.

To form the portion that comes into contact with the thermal activation sheet N by using a member different from that of the other portion as described above, for example, a specific member may be formed into a sheet and affixed onto the portion of the radiator plate 22 which comes into contact with the thermal activation sheet N.

While in the above embodiment the temperature sensor that directly measures the temperature of the overhanging portion 22H of the radiator plate 22 is exemplified as temperature detecting means for detecting the temperature of the radiator, in the case where, for instance, there is a correlation between the temperature at a spaced location from the radiator and the temperature of the radiator, the temperature of the radiator may be detected indirectly based on the temperature at the spaced location.

Other than the above, the specific details etc. set forth in the above embodiment, such as the shape, size, and presence/absence of the radiator fins of the radiator plate 22, and the shape of the overhanging portion 22H of the radiator plate 22, may be changed as appropriate.

Further, while the thermally activation device exemplified in the above embodiment is one which activates the adhesive layer by heating the thermal activation sheet N cut into a predetermined length, it is also possible to construct one thermal activation device by combining a printing mechanism which effects printing processing on the surface of the thermal activation sheet N and a cutting mechanism which cuts the thermal activation sheet N wound in a roll-like shape into a predetermined length.

What is claimed is:

1. A thermal activation device comprising:

a thermal head having a plurality of heat generating elements for generating heat to heat an adhesive layer surface of a thermal activation sheet; and a radiator for absorbing and dissipating heat generated by the heat generating elements of the thermal head, the radiator having a portion disposed in contact with an introduction path along which the thermal activation sheet is introduced toward the thermal head for contacting the adhesive layer surface of the thermal activation sheet to preheat the thermal activation sheet as the thermal activation sheet advances in the introduction path.

2. A thermal activation device according to claim 1; further comprising temperature detecting means for detecting a temperature of the radiator.

3. A thermal activation device according to claim 2; further comprising control means for controlling an amount of heat applied from the heat generating elements of the thermal head to the thermal activation sheet; and wherein the control means includes means for varying the amount of heat to be applied to the thermal activation sheet in accordance with a detection result from the temperature detecting means.

4. A thermal activation device according to claim 3; further comprising drive means for performing a driving operation to transport the thermal activation sheet at a controlled variable speed; and wherein the control means includes means for controlling the drive means to vary a transport speed for the thermal activation sheet to control an amount of heat applied from the heat generating elements of the thermal head to the thermal activation sheet.

5. A thermal activation device according to claim 4; wherein the portion of the radiator which comes into contact with the adhesive layer surface of the thermal activation sheet is has a lower heat conductivity than that of other portions of the radiator.

6. A thermal activation device according to claim 3; wherein the portion of the radiator which comes into contact with the adhesive layer surface of the thermal activation sheet has a lower heat conductivity than that of other portions of the radiator.

7. A thermal activation device according to claim 2; wherein the portion of the radiator which comes into contact with the adhesive layer surface of the thermal activation sheet has a lower heat conductivity than that of other portions of the radiator.

8. A thermal activation device according to claim 1; wherein the radiator is integrally connected to the thermal head.

9. A thermal activation device according to claim 8; further comprising a frame; and wherein the radiator is pivotally mounted on the frame so that the radiator and the thermal head undergo pivotal movement relative to the frame.

10. A thermal activation device according to claim 1; wherein the portion of the radiator has a surface for surface-to-surface contact with the thermal activation sheet to preheat the thermal activation sheet as the thermal activation sheet advances in the introduction path.

11. A thermal activation device according to claim 1; further comprising a platen roller for advancing the thermal activation sheet towards the thermal head while pressing the thermal activation sheet against the thermal head.

12. A thermal activation device according to claim 11; wherein the portion of the radiator is disposed opposite to and confronts the platen roller.

13. A thermal activation device comprising: a thermal head having a plurality of heat generating elements for generating heat to heat a thermal activation sheet; and a radiator for absorbing and dissipating heat generated by the heat generating elements of the thermal head, the radiator having a portion disposed in contact with an introduction path along which the thermal activation sheet is introduced toward the thermal head for contacting the thermal activation sheet to preheat the thermal activation sheet as the thermal activation sheet advances in the introduction path; wherein the portion of the radiator which comes into contact with the thermal activation sheet has a lower heat conductivity than that of other portions of the radiator.

14. A thermal activation device comprising: a thermal head for generating thermal activation energy to thermally activate an adhesive layer surface of a thermal activation sheet; a radiator for absorbing and dissipating heat from the thermal activation energy generated by the thermal head, the radiator having a portion for contacting the adhesive layer surface of the thermal activation sheet to preheat and thermally activate the thermal activation sheet; temperature detecting means for detecting a temperature of the radiator; and control means for controlling the thermal activation energy generated by the thermal head in accordance with the temperature of the radiator detected by the temperature detecting means.

15. A thermal activation device according to claim 14; wherein the radiator is integrally connected to the thermal head.

16. A thermal activation device according to claim 15; further comprising a frame; and wherein the radiator is pivotally mounted on the frame so that the radiator and the thermal head undergo pivotal movement relative to the frame.

17. A thermal activation device according to claim 14; wherein the portion of the radiator has a surface for surface-to-surface contact with the adhesive layer surface of the thermal activation sheet to preheat the thermal activation sheet.

18. A thermal activation device according to claim 14; wherein the control means controls the thermal activation energy generated by the thermal head by lowering the thermal activation energy when the temperature of the radiator detected by the temperature detecting means is a preselected high temperature and by increasing the thermal activation energy when the temperature of the radiator detected by the temperature detecting means is a preselected low temperature.

19. A thermal activation device according to claim 14; wherein the portion of the radiator has a curved surface for contacting the thermal activation sheet.

20. A thermal activation device according to claim 14; further comprising a platen roller for advancing the thermal activation sheet towards the thermal head while pressing the thermal activation sheet against the thermal head.

21. A thermal activation device according to claim 20; wherein the portion of the radiator is disposed opposite to and confronts the platen roller.

22. A thermal activation device comprising: a thermal head for generating thermal activation energy to thermally activate a thermal activation sheet; a radiator for absorbing and dissipating heat from the thermal activation energy generated by the thermal head, the radiator having a portion for contacting the thermal activation sheet to preheat and thermally activate the thermal activation sheet; temperature detecting means for detecting a temperature of the radiator; and control means for controlling the thermal activation energy generated by the thermal head in accordance with the temperature of the radiator detected by the temperature detecting means; wherein the portion of the radiator which comes into contact with the thermal activation sheet has a lower heat conductivity than that of other portions of the radiator.

* * * * *